US007264879B2

(12) United States Patent
Sue et al.

(10) Patent No.: US 7,264,879 B2
(45) **Date of Patent: *Sep. 4, 2007**

(54) COMPOSITE CONSTRUCTIONS WITH ORIENTED MICROSTRUCTURE

(75) Inventors: J. Albert Sue, The Woodlands, TX (US); Ghanshyam Rai, The Woodlands, TX (US); Zhigang Fang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/957,326

(22) Filed: Sep. 30, 2004

(65) Prior Publication Data

US 2005/0112396 A1 May 26, 2005

Related U.S. Application Data

(63) Continuation of application No. 10/242,203, filed on Sep. 12, 2002, now Pat. No. 6,841,260, which is a continuation of application No. 09/549,974, filed on Apr. 14, 2000, now Pat. No. 6,451,442, which is a continuation of application No. 08/903,668, filed on Jul. 31, 1997, now Pat. No. 6,063,502.

(60) Provisional application No. 60/023,655, filed on Aug. 1, 1996.

(51) Int. Cl.
*B22F 3/00* (2006.01)
*B22F 3/18* (2006.01)

(52) U.S. Cl. ..... 428/411.1; 428/469; 428/688; 428/689; 428/698; 175/425

(58) Field of Classification Search ..... 428/469, 428/408, 698; 175/425, 426, 434
See application file for complete search history.

(56) References Cited

U.S. PATENT DOCUMENTS 4,255,165 A 3/1981 Dennis et al.
4,378,975 A 4/1983 Tomlinson et al.

(Continued)

FOREIGN PATENT DOCUMENTS

GB 1572460 7/1980
GB 2315778 11/1998

OTHER PUBLICATIONS

Technological Advances, *Flaw Tolerant, Fracture Resistant, Non-Brittle Materials PRoduced via Conventional Powder Processing*, 1995 Matrice Technology Ltd., p. 131-134.

(Continued)

*Primary Examiner*—Jennifer McNeil
*Assistant Examiner*—Jason L. Savage
(74) *Attorney, Agent, or Firm*—Jeffer, Mangels, Butler & Marmaro, LLP

(57) ABSTRACT

In one embodiment, composite constructions of the invention are in the form of a plurality of coated fibers bundled together to produce a fibrous composite construction in the form of a rod. Each fiber has a core formed from a hard phase material, that is surrounded by a shell formed from a binder phase material. In another embodiment of the invention, monolithic sheets of the hard phase material and the binder phase material are stacked and arranged to produce a swirled composite in the form of a rod. In still another embodiment of the invention, sheets formed from coated fibers are arranged to produce a swirled composite. Inserts for use in such drilling applications as roller cone rock bits and percussion hammer bits, and shear cutters for use in such drilling applications as drag bits, that are manufactured using conventional methods from these composite constructions exhibit increased fracture toughness due to the continuous binder phase around the hard phase of the composites. These binder phases increase the overall fracture toughness of the composite by blunting or deflecting the tip of a propagating crack.

6 Claims, 6 Drawing Sheets

U.S. PATENT DOCUMENTS 4,772,524 A 9/1988 Cobienz
5,350,637 A * 9/1994 Ketcham et al. ..... 428/539.5
5,419,868 A 5/1995 Honnorat
5,492,186 A 2/1996 Overstreet et al.
5,645,781 A 7/1997 Popovic' et al.
6,240,720 B1 * 6/2001 Tseng et al. ..... 60/770
6,635,357 B2 * 10/2003 Moxson et al. ..... 428/548

OTHER PUBLICATIONS

Advance Ceramics Research, *Research & Development Summaries*, Aug. 18, 1996.

* cited by examiner

COMPOSITE CONSTRUCTIONS WITH ORIENTED MICROSTRUCTURE

CROSS REFERENCE TO RELATED APPLICATIONS

This application is a continuation of U.S. patent application Ser. No. 10/242,203, filed on Sep. 12, 2002 now U.S. Pat. No. 6,841,260 which is a continuation of U.S. patent application Ser. No. 09/549,974, filed on Apr. 14, 2000, now U.S. Pat. No. 6,451,442 which is a continuation of patent application Ser. No. 08/903,668, filed on Jul. 31, 1997, now U.S. Pat. No. 6,063,502 which claims benefit of U.S. Application No. 60/023,655, filed on Aug. 1, 1996.

FIELD OF THE INVENTION

This invention relates generally to composite constructions comprising a hard material phase and a relatively softer ductile material phase and, more particularly, to composite constructions that are designed having an oriented microstructure to provide improved properties of fracture toughness, when compared to conventional cermet materials such as cemented tungsten carbide, and polycrystalline diamond, cubic boron nitride, and the like.

BACKGROUND OF THE INVENTION

Cermet materials such as cemented tungsten carbide (WC—Co) are well known for their mechanical properties of hardness, toughness and wear resistance, making them a popular material of choice for use in such industrial applications as cutting tools for machining, mining and drilling where its mechanical properties are highly desired. Cemented tungsten carbide, because of its desired properties, has been a dominant material used in such applications as cutting tool surfaces, hard facing, wear component and roller cone rock bit inserts, and cutting inserts in roller cone rock bits, and as the substrate body for drag bit shear cutters. The mechanical properties associated with cemented tungsten carbide and other cermet material, especially the unique combination of hardness, toughness and wear resistance, make this class of materials more desirable than either metal or ceramic materials alone.

For conventional cemented tungsten carbide, the mechanical property of fracture toughness is inversely proportional to hardness, and wear resistance is proportional to hardness. Although the fracture toughness of cemented tungsten carbide has been somewhat improved over the years, it is still a limiting factor in demanding industrial applications such as high penetration drilling, where cemented tungsten carbide inserts often exhibit gross brittle fracture that can lead to catastrophic failure. Traditional metallurgical methods for enhancing fracture toughness, such as grain size refinement, cobalt content optimization, and strengthening agents, have been substantially exhausted with respect to conventional cemented tungsten carbide.

The mechanical properties of commercial grade cemented tungsten carbide can be varied within a particular envelope by adjusting the cobalt metal content and the tungsten carbide grain sizes. For example, the Rockwell A hardness of cemented tungsten carbide can be varied from about 85 to 94, and the fracture toughness can be varied from about 8 to 19 $Mpam^{-2}$. Applications of cemented tungsten carbide are limited to this envelope.

Polycrystalline diamond is another type of material that is known to have desirable properties of hardness, and wear resistance, making it especially suitable for those demanding applications described above where high wear resistance is desired. However, this material also suffers from the same problem as cemented tungsten carbide, in that it also displays properties of low fracture toughness that can result in gross brittle failure during usage.

It is, therefore, desirable that a composite construction be developed that has improved properties of fracture toughness, when compared to conventional cermet materials such as cemented tungsten carbide materials, and when compared to conventional materials formed from polycrystalline diamond or cubic boron nitride. It is desirable that such composite construction have such improved fracture toughness without sacrificing other desirable properties of wear resistance and hardness associated with conventional cemented tungsten carbide, polycrystalline diamond, and polycrystalline cubic boron nitride materials. It is desired that such composite constructions be adapted for use in such applications as roller cone bits, hammer bits, drag bits and other mining, construction and machine applications where properties of improved fracture toughness is desired.

SUMMARY OF THE INVENTION

Composite constructions having oriented microstructures, prepared according to principles of this invention, have improved properties of fracture toughness when compared to conventional cermet materials. In one embodiment of the invention, coated fibers, comprising a core formed from a hard phase material is surrounded by a shell formed from a binder phase material. The plurality of fibers are bundled together to produce a fibrous composite construction in the form of a rod. In another embodiment of the invention, monolithic sheets of the hard phase material and the binder phase material are stacked and arranged to produce a swirled composite in the form of a rod. In still another embodiment of the invention, sheets formed from coated fibers are arranged to produce a swirled composite.

The hard phase can be a cermet comprising a ceramic material selected from the group consisting of carbides, borides, and nitrides from groups IVB, VB, and VIB of the periodic table (CAS version), and a ductile metal material selected from the group consisting of Co, Ni, Fe, W, Mo, Cu, Al, Nb, Ti, Ta, and alloys thereof. Alternatively, the hard phase can be in the form of polycrystalline diamond or polycrystalline cubic boron nitride, or a mixture of these materials with a cermet material. The binder phase is selected from the groups of materials consisting of Co, Ni, Fe, W, Mo, Cu, Al, Nb, Ti, Ta, and alloys thereof. Alternatively, the binder phase can be a cermet material, for example when the hard phase material is polycrystalline diamond or polycrystalline cubic boron nitride.

Inserts for use in such drilling applications as roller cone rock bits and percussion hammer bits, and shear cutters for use in such drilling applications as drag bits, that are manufactured using conventional methods from these composite constructions exhibit increased fracture toughness due to the continuous binder phase around the hard phase of the composites. These binder phases increase the overall fracture toughness of the composite by blunting or deflecting the tip of a propagating crack.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

Ceramic materials generally include metal carbides, borides, silicides, diamond and cubic boron nitride (cBN). Cermet materials are materials that comprise both a ceramic material and a metal material. An example cermet material is cemented tungsten carbide (WC—Co) that is made from tungsten carbide (WC) grains and cobalt (Co). Another class of cermet materials is polycrystalline diamond (PCD) and polycrystalline cBN (PCBN) that have been synthesized by high temperature/high pressure processes. Cemented tungsten carbide is widely used in industrial applications that require a unique combination of hardness, fracture toughness, and wear resistance.

Figure 1:
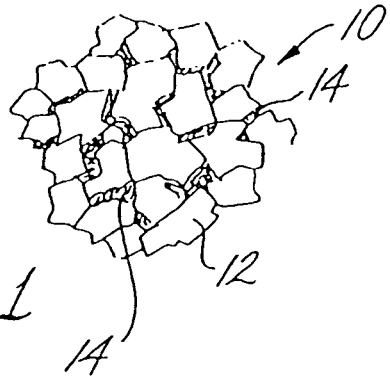
FIG. 1 is a schematic photomicrograph of a portion of convention cemented tungsten carbide.

FIG. 1 illustrates the conventional microstructure of cemented tungsten carbide 10 as comprising tungsten carbide grains 12 that are bonded to one another by the cobalt phase 14. As illustrated, the tungsten carbide grains can be bonded to other grains of tungsten carbide, thereby having a tungsten carbide/tungsten carbide interface, and/or can be bonded to the cobalt phase, thereby having a tungsten carbide/cobalt interface. The unique properties of cemented tungsten carbide result from this combination of a rigid carbide network with a tougher metal substructure. The generic microstructure of cemented tungsten carbide, a heterogenous composite of a ceramic phase in combination with a metal phase, is similar in all cermets.

The relatively low fracture toughness of cemented tungsten carbide has proved to be a limiting factor in more demanding applications, such as inserts in roller cone rock bits, hammer bits and drag bits used for subterranean drilling and the like. It is possible to increase the toughness of the cemented tungsten carbide by increasing the amount of cobalt present in the composite. The toughness of the composite mainly comes from plastic deformation of the cobalt phase during the fracture process. Yet, the resulting hardness of the composite decreases as the amount of ductile cobalt increases. In most commonly used cemented tungsten carbide grades, cobalt is no more than about 20 percent by weight of the total composite.

As evident from FIG. 1, the cobalt phase is not continuous in the conventional cemented tungsten carbide microstructure, particularly in compositions having a low cobalt concentration. The conventional cemented tungsten carbide microstructure has a relatively uniform distribution of tungsten carbide in a cobalt matrix. Thus, a crack propagating through the composite will often travel through the less ductile tungsten carbide grains, either transgranularly through tungsten carbide/cobalt interfaces or intergranularly through tungsten carbide/tungsten carbide interfaces. As a result, cemented tungsten carbide often exhibits gross brittle fracture during more demanding applications, which may lead to catastrophic failure.

Generally, the present invention focuses on composite constructions having an oriented microstructure comprising arrangements of hard phase materials, e.g., cermet materials, PCD, PCBN and the like, and relatively softer binder phase materials, e.g, metals, metal alloys, and in some instances cermet materials. Composite constructions with oriented microstructures of this invention generally comprise a continuous binder phase that is disposed around the harder phase of the composite to maximize the ductile effect of the binder phase.

The term "binder phase" as used herein refers to the phase of material that surrounds the relatively harder hard phase material. Depending on the particular invention embodiment, the binder phase can be in the form of a shell that surrounds a core of the hard phase material, or can be in the form of a sheet that is coiled around a sheet of the hard phase material. Conversely, the term "hard phase material" as used herein refers to the phase of material that is surrounded by the relatively softer binder phase material. Depending on the particular invention embodiment, the hard phase material can be in the form of a core that is surrounded by a shell of the binder phase material, or can be in the form of a sheet that is coiled around a sheet of the binder phase material.

As mentioned above, the fracture toughness of conventional cemented tungsten carbide or other cermets is controlled by its ductile metal binder (e.g., cobalt). Plastic deformation of the binder phase during the crack propagation process accounts for more than 90 percent of the fracture energy. Composite constructions of this invention are designed having a maximum fracture path through the binder phase, thereby improving the ability of the composite to blunt or deflect the tip of a propagating crack. For example, roller cone rock bit inserts that are manufactured from composite constructions of this invention having oriented microstructures are known to display increased fracture toughness, resulting in extended service life.

Figure 2:
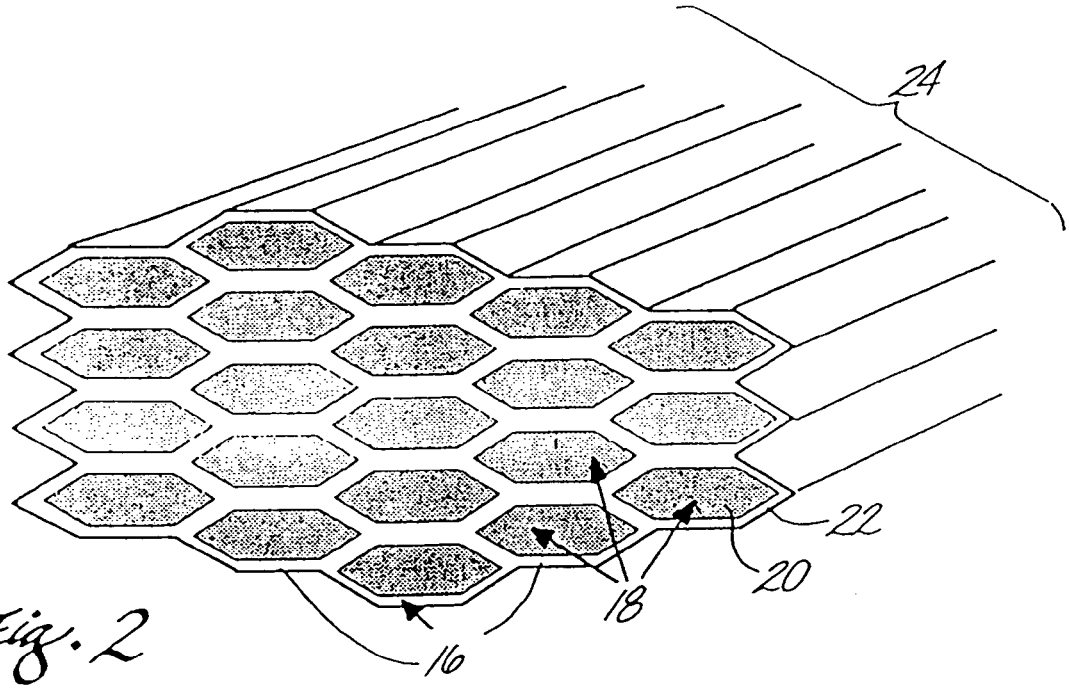
FIG. 2 is a perspective cross-sectional side view of a first embodiment composite construction of this invention.

The structural arrangement of the hard phase material and the binder phase in composite constructions of the invention may take several forms. Referring to FIG. 2, a first embodiment composite construction 16 of this invention comprises a plurality of bundled together cylindrical cased or coated fibers 18. Each fiber 18 comprises a core 20 formed from the hard phase material. Each core 20 is surrounded by a shell or casing 22 formed from the binder phase material. The shell or casing can be applied to each respective core by the method described in U.S. Pat. No. 4,772,524, which is incorporated herein by reference, or by other well known spray or coating processes. Additionally, "Flaw Tolerant, Fracture Resistant, Non-Brittle Materials Produced Via Conventional Powder Processing," (*Materials Technology, Volume* 10 1995, pp. 131-149), which is also incorporated herein by reference, describes an extrusion method for producing such coated fibers 18.

The plurality of coated fibers 18 are oriented parallel to a common axis and are bundled together and extruded into a rod 24, which comprises a cellular composite construction made up of binder phase material with hard phase material cores. Typically, before extrusion the loose fibers 18 in the bundles are round in transverse cross section. After extrusion the fibers 18 are squashed together and have a generally hexagonal cross section. The fibers may be deformed into other shapes locally where the fibers are not parallel to each other in the bundle or are not aligned to yield the regular hexagonal pattern illustrated. The fibers 18 are bonded together by heating to form an integral mass.

In an example first embodiment, the composite construction is produced from a plurality of coated fibers 18 having a core 20 of tungsten carbide and cobalt powder (as the hard phase material) surrounded by a shell 22 of cobalt metal (as the ductile phase). The fibers are fabricated from a mixture of powdered WC—Co, powdered Co, and thermoplastic binder such as wax by the extrusion process identified above. The binder may be as much as 50 percent by volume of the total mixture. Tungsten carbide powder and cobalt powder are available in micron or submicron sizes, although it is desired that the tungsten carbide powder have a particle size of less than about 20 micrometers. A plurality of these cobalt cased WC—Co fibers 18 are bundled together and extruded to form a fibrous WC—Co composite construction. The extruded rod 24 can be cut to a desired geometry of the finished part, for example a cylinder with an approximately conical end for forming an insert for a rock bit, or sliced to form a cutting surface for placement onto a cutting substrate.

The composite construction is then dewaxed by heating in a vacuum or protective atmosphere to remove the thermoplastic binder. Upon heating to elevated temperature near the melting point of cobalt, a solid, essentially void-free integral composite is formed. The regions defined by the fibers 18 have a WC—Co core 20 thickness in the range of from about 30 to 300 micrometers, surrounded by a shell 22 of cobalt having a thickness in the range of from about 3 to 30 micrometers.

Although use of a cemented tungsten carbide material and cobalt have been described above as example respective hard phase materials and binder materials for forming the respective core 20 and shell 22, it is to be understood that composite constructions of this invention may be formed from many other different materials that are discussed in detail below.

For example, a first embodiment composite construction can comprise a fiber core 20 formed from PCB or PCBN as the hard phase material, and a shell 22 formed from cobalt metal as the binder phase. Alternatively, the shell 22 can be formed from any other binder phase material that is relatively more ductile, including cemented tungsten carbide. In such example first embodiment, the core 20 is formed from a PCD or PCBN composition according to the process described in U.S. Pat. Nos. 4,604,106; 4,694,918; 5,441,817; and 5,271,749 that are each incorporated herein by reference, starting with diamond or cBN powder and wax. Each PCD core 20 is surrounded by a cobalt metal shell 22 to form the fiber 18, and a plurality of the fibers 18 are bundled together and extruded to form a fibrous PCD-cobalt composite construction. The regions defined by the fibers 20 have a PCD core 20 thickness in the range of from about 30 to 300 micrometers, surrounded by a shell 22 of cobalt having a thickness in the range of from about 3 to 30 micrometers.

Figure 3:
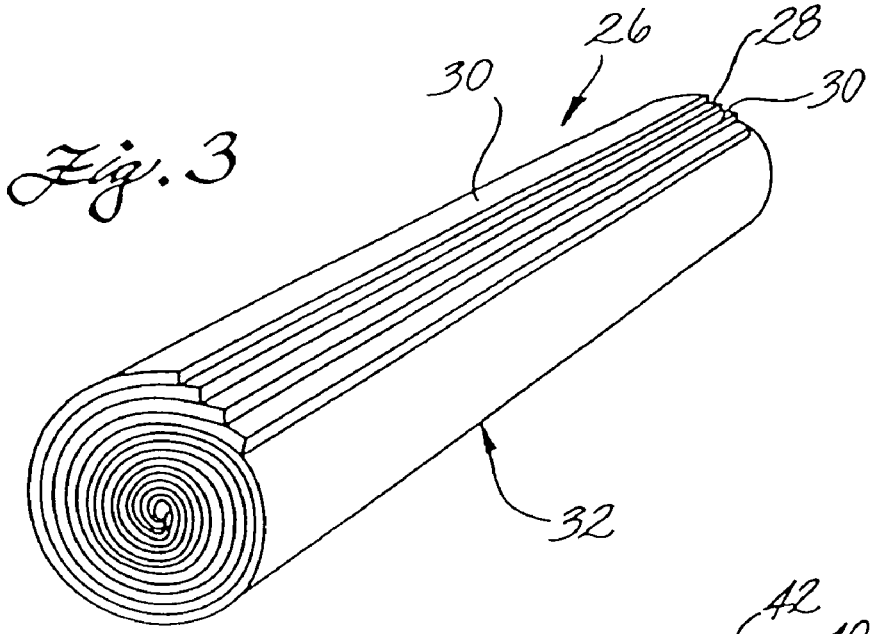
FIG. 3 is a perspective side view of a second embodiment composite construction of this invention.

Referring to FIG. 3, a second embodiment composite construction 26, prepared according to principles of the invention, comprises a repeating arrangement of monolithic sheets 28 of the hard phase material, and sheets 30 of the binder phase that are arranged to produce a swirled or coiled composite construction. In an example second composite construction embodiment, the sheets 28 are formed from a powder cermet material, and sheets 30 are formed from a powder metal. A thermoplastic binder is added to both powder sheets 28 and 30 for cohesion and to improve the adhesion between the adjacent sheets. The sheets 28 of the hard phase material and the sheets 30 of the binder phase are alternately stacked on top of one another and coiled into a rod 32 having a spiral cross section. Additionally, depending on the desired composite construction properties for a particular application, the sheets 28 and 30 may be formed from more than one type of hard phase material and/or more than one type of binder phase material, and can be stacked in random fashion, to form the second embodiment composite rod 32 of this invention.

In an example second composite embodiment, the sheets 28 are formed from powdered WC—Co, and the sheets 30 are formed from powdered cobalt. The WC—Co sheets 28 are formed having a thickness in the range of from about 50 to 300 micrometers, and the cobalt sheets 30 are formed having a thickness in the range of from about 5 to 10 micrometers after consolidation by dewaxing and sintering near the melting point of cobalt. Alternatively, the sheets 28 can be formed from PCD or PCBN, and the sheets 30 can be formed from a relatively more ductile binder material such as metals, metal alloys, cermets and the like.

Figure 4:
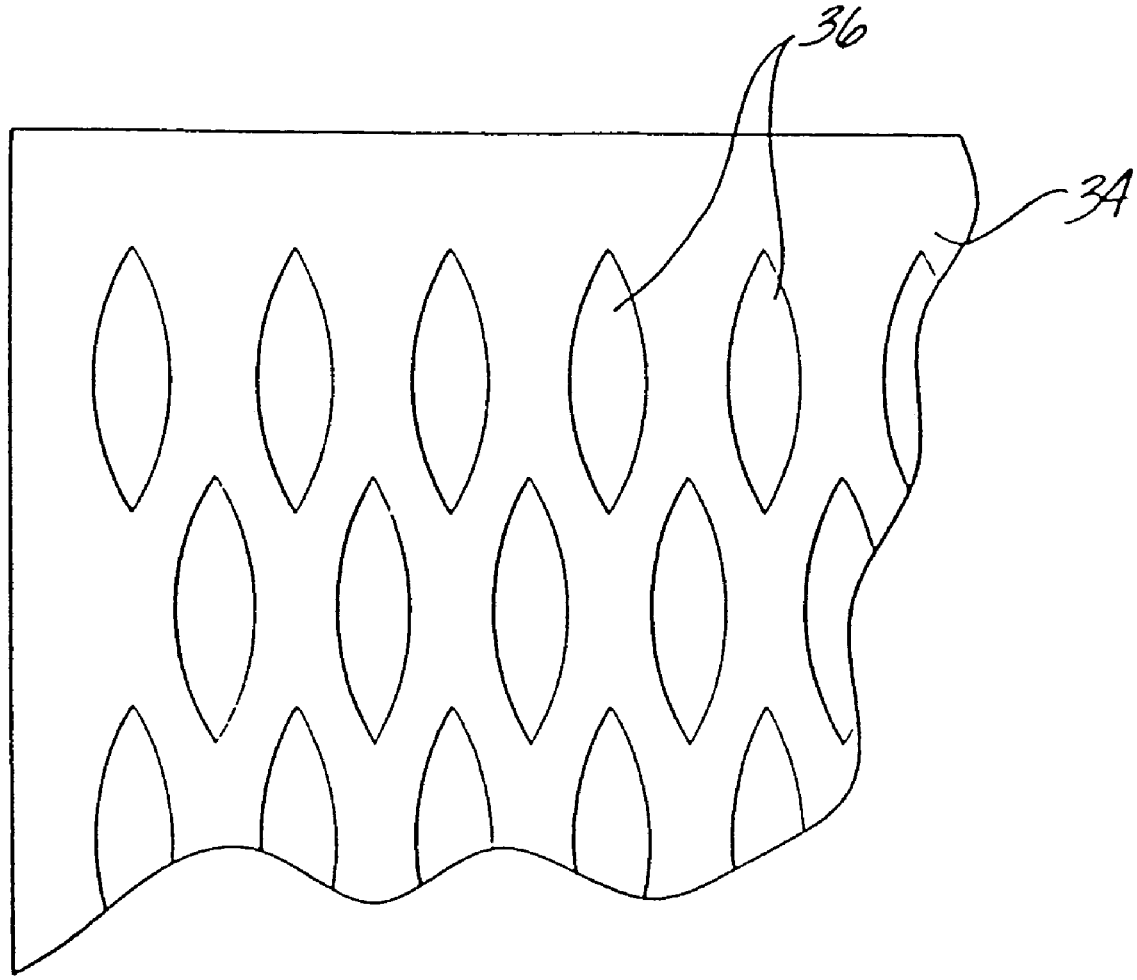
FIG. 4 is an elevational view of a third embodiment composite construction of this invention.

In a third composite construction embodiment having an oriented microstructure, sheets 34 in the form of expanded metal sheets, shown in FIG. 4, may be used in place of the sheets 30 to form the coiled composite rod of FIG. 3. One method for creating such expanded metal sheet 34 is to form a plurality of parallel slits 36 in a metal sheet, and stretch the metal sheet in a direction perpendicular to the slits to cause the slits to expand. Properties of the finally-formed composite can be controlled by stacking alternate sheets of expanded sheet 34 and non-expanded sheet 30, or by varying the spacing of the slits 36. The stacked sheets can be rolled or pressed to minimize void volume of the expanded sheet, or they may be coiled to form a tight roll and swaged or drawn to reduce void volume.

Figure 5:
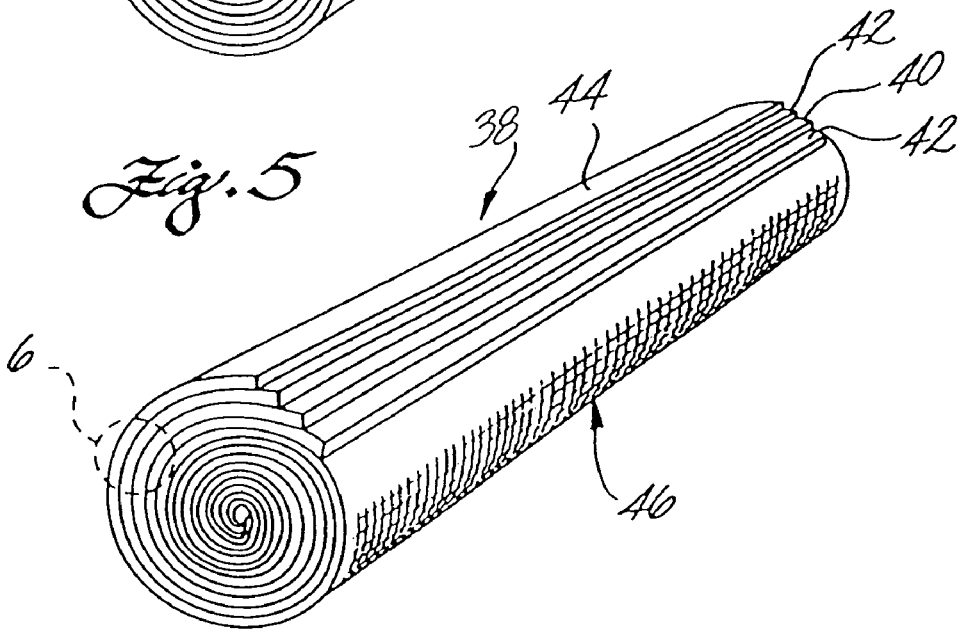
FIG. 5 is a perspective side view of a fourth embodiment composite construction of this invention.
Figure 6:
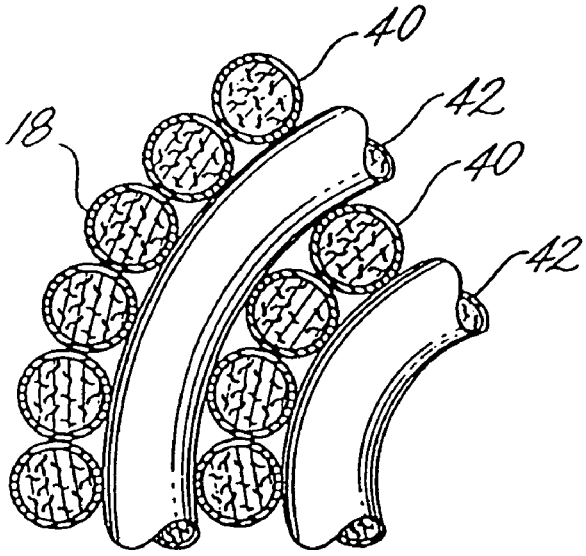
FIG. 6 is an enlarged view of the fourth embodiment composite construction of section 6 in FIG. 5.

Referring to FIG. 5, in a fourth embodiment composite construction 38 having an oriented microstructure, coated fibers 18 (as shown in FIGS. 1 and 6) that are constructed the same as described above for the first embodiment are used to form a plurality of sheets 40, 42 and 44 that are arranged to produce a coiled fibrous composite. The fibers 18 may be oriented in any manner desired to form the sheets, depending on the desired composite properties for a particular application. For example, the fibers 18 within each sheet may be oriented parallel to one another, as in sheets 40 and 42 (as illustrated in FIG. 6), or the fibers 18 in each sheet may be interwoven as in sheet 44 (as best shown in FIG. 5). Sheets 40, 42 and 44 are stacked on top of one another and coiled into a fibrous composite rod 46. Preferably, the sheets are stacked in such a manner that adjacent sheets have different fiber orientations. An exemplary cross section of such a rod 46 is illustrated in FIG. 6.

Composite construction products, when formed in the shape of a rod, are extruded or swaged to the diameter for example of roller cone rock bit insert blanks, and cut to form a plurality of insert blanks. The blanks may be machined to form the ends of rock bit inserts, or conventional pressing and sintering methods may be used to form the blanks into rock bit inserts.

Figure 7:
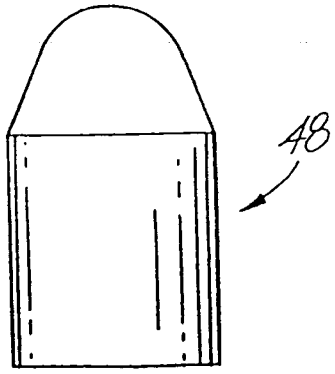
FIG. 7 is a perspective side view of an insert for use in a roller cone or a hammer drill bit formed from a composite construction of this invention.

Referring to FIG. 7, an insert 48 for use in a wear or cutting application in a roller cone drill bit or percussion or hammer drill bit may be formed from composite constructions having oriented microstructures of this invention. For example, such inserts can be formed from blanks that are made from fourth embodiment composite constructions of this invention, and that are pressed or machined to the desired shape of a roller cone rock bit insert. The shaped inserts are then heated to about 200 to 400° C. in vacuum or flowing inert gas to debind the composite, and the inserts are then sintered. When using fibers formed from WC—Co, although conventional cemented tungsten carbide is typically sintered at temperatures of 1360 to 1450° C., the sintering of the composite according to this invention should occur below 1360° C., and more preferably in the range of from about 1280 to 1300° C.

Other consolidation techniques well known in the art may be used during the manufacture of composite constructions of this invention, including normal liquid phase sintering, hot pressing, hot isostatic pressing (HIPing) as described in U.S. Pat. No. 5,290,507 that is incorporated herein by reference, and rapid omnidirectional compaction (ROC) as described in U.S. Pat. Nos. 4,945,073; 4,744,943; 4,656,002; 4,428,906; 4,341,577 and 4,124,888 which are each incorporated herein by reference.

Composite constructions having oriented microstructures, prepared according to principles of this invention, exhibit a higher fracture toughness than conventional cermet materials such as cemented tungsten carbide, due to the ordered arrangement of the binder phase (e.g., the binder phase shell or sheet) within the composite that is arranged to form a continuous, or nearly continuous, phase around the hard phase material (e.g., the finer core or sheet) within the composite. The arrangement of binder phase continuously around the lower toughness hard metal phase increases the overall fracture toughness of the composite by blunting or deflecting the front of a propagating crack.

The hard phase materials useful for forming the fiber core 20 and sheets 28 in composite constructions of this invention can be selected from the group of cermet materials including, but not limited to, carbides, borides and nitrides of the group IVB, VB, and VIB metals and metal alloys of the periodic table (CAS version). Example cermet materials include: WC-M, TiC-M, TaC-M, VC-M, and Cr.sub.3C.sub.2-M, where M is a metal such as Co, Ni, Fe, or alloys thereof as described above. A preferred cermet material is WC—Co. Additionally, the hard phase material include PCD, PCBN, and mixtures of PCD and PCBN with carbides, borides and nitrides of the group IVB, VB, and VIB metals and metal alloys of the periodic table (CAS version). Composite constructions of this invention comprising PCD as the hard phase material are highly desirable because they are known to increase the fracture toughness of PCD by as much as two fold.

The binder phase useful for forming the fiber shell 22 and sheets 30 in composite constructions of this invention can be selected from the group IVB, VB, and VIB ductile metals and metal alloys of the periodic table (CAS version) including, but not limited to Fe, Ni, Co, Cu, Ti, Al, Ta, Mo, Nb, W, and their alloys. Additionally, the binder phase can be formed from the group including carbides, borides and nitrides of the group IVB, VB, and VIB ductile metals and metal alloys of the periodic table (CAS version), when the hard phase material (e.g., the fiber core) is PCD or PCBN because of their properties of good thermal expansion compatibility and good toughness. For example, the binder phase can be WC—Co when the hard phase material is PCD or PCBN. A preferred binder phase is cobalt when the hard phase material is WC—Co. Additionally, W—Ni—Fe is a desirable metal alloy for the binder phase when the hard phase material is WC—Co because it is a liquid phase sintering system. During a conventional liquid phase sintering process for WC—Co, W—Ni—Fe will be a solid/liquid mixture with a majority being solid. Therefore it will remain in the "shell" (in the case of a fiber composite composition embodiment) during and after sintering as in a green state.

In order to enhance the fracture toughness of composite constructions of this invention, the thickness of the binder phase surrounding each fiber core or each hard phase material sheet should be greater than the mean free path between hard phase grains, e.g., tungsten carbide, in the core. That is, the thickness of the shell of binder phase metal between adjacent regions of cermet materials, e.g., cemented tungsten carbide (WC—Co), should be more than the mean thickness of cobalt between the tungsten carbide grains in the core.

The volume fraction of the continuous binder phase in the composite construction will influence the properties of the overall composite, including fracture toughness. The volume fraction of the binder phase may be in the range of from about 15 to 50 percent by volume, based on the total volume of the composite. Preferably, for composite constructions designed for use in more demanding applications, the binder phase can be in the range of from about 15 to 30 percent by volume of the total volume of the composite.

Composite constructions having oriented microstructures, prepared according to principles of this invention, will be better understood and appreciated with reference to the following examples:

EXAMPLE NO. 1

Fiber Composite Construction (WC—Co Core)

A fiber composite construction included a hard phase material core formed from WC—Co that was made from WC powder and Co powder, having an average grain size in the range of from about one to six micrometers. The WC—Co contained greater than about six percent by weight Co, based on the total weight of the WC—Co. The binder phase fiber shell was formed from Co, but alternatively could be formed from any of the above-identified metals or metal alloys. Each fiber had a diameter in the range of from 30 to 300 micrometers after consolidation.

EXAMPLE NO. 2

Fiber Composite Construction (PCD Core)

A fiber composite construction included a core formed from PCD according to techniques described in U.S. Pat. Nos. 4,604,106; 4,694,918; 5,441,817; and 5,271,749. Diamond powder was used having an average grain size in the range of from about 4 to 100 micrometers, and was mixed with wax according to the referenced process, and was sintered to form the PCD. The binder phase fiber shell was formed from 411 carbide (i.e., WC comprising 11 percent by weight cobalt and having a WC grain size of approximately four micrometers). Alternatively, the fiber shell could be formed from any of the above-identified metals, metal alloys, and cermets. Each fiber had a diameter in the range of from 30 to 300 micrometers after consolidation.

EXAMPLE NO. 3

Fiber Composite Construction (PCBN Core)

A fiber composite construction included a core formed from PCBN and WC—Co. The WC—Co was made from WC powder and Co powder having an average grain size in the range of from about one to six micrometers, and the PCBN was in the form of cBN powder having an average grain size in the range of from about 40 to 100 micrometers. The WC—Co contained greater than about six percent by weight Co, based on the total weight of the WC—Co. The core comprised in the range of from about 50 to 95 percent by volume PCBN based on the total volume of the core. Alternatively, the core can be formed from PCBN and TiC, or cBN and TiN+Al, or cBN and TiN+$CO_2Al_9$, where the core comprises in the range of from about two to ten percent by weight Al or $CO_2Al_9$ based on the total weight of the core.

The binder phase fiber shell was formed from WC—Co, made in the same manner described above for the core. Alternatively, the fiber shell could be formed from any of the above-identified metals, metal alloys or cermet materials. Each fiber had a diameter in the range of from 30 to 300 micrometers.

EXAMPLE NOS. 4 TO 6

Bundled Fiber Composite Construction

Bundles were formed in the manner described above from the fiber composite constructions of Example Nos. 1 to 3 for the application of a roller cone rock bit insert. Example No. 4 bundle was formed by combining the fibers of Example Nos. 1 and 2 together. Example No. 5 bundle was formed by combining the fibers of Example Nos. 2 and 3 together. Example No. 6 bundle was formed by combining the fibers of Example Nos. 1, 2 and 3 together.

EXAMPLE NO. 7

Hard Phase Material Sheet (WC—Co Sheet)

A hard phase sheet comprising WC—Co was made from WC powder and Co powder having an average grain size in the range of from about one to six micrometers. The WC—Co contained greater than about six percent by weight Co, based on the total weight of the WC—Co. The sheet had a thickness in the range of from about 30 to 300 micrometers after consolidation.

EXAMPLE NO. 8

Hard Phase Material Sheet (PCD Sheet)

A hard phase sheet comprising PCD was prepared according to the technique described in the above-identified U.S. Patent, starting with diamond powder having an average particle size in the range of from about 4 to 100 micrometers. The sheet had a thickness in the range of from about 30 to 300 micrometers after consolidation.

EXAMPLE NO. 8

Hard Phase Material Sheet (PCBN Sheet)

A hard phase material sheet comprising PCBN and WC—Co was made from WC powder and Co powder having an average grain size in the range of from about one to six micrometers, and the cBN was in the form of powder having an average grain size in the range of from about 4 to 100 micrometers. The WC—Co contained greater than about six percent by weight Co, based on the total weight of the WC—Co. The sheet had a thickness in the range of from about 30 to 300 micrometers after consolidation.

EXAMPLE NO. 9

Binder Phase Sheet

A binder phase sheet was made from Co. Alternatively, the sheet could have been made from any one of the above-identified metals or metal alloys. The sheet had a thickness in the range of from about 3 to 30 micrometers after consolidation.

EXAMPLE NOS. 10 TO 13

Spiral Composite Constructions

Spiral composite constructions for use as tapes were prepared by combining alternating sheets of Example Nos. 6 to 9. Example No. 10 spiral composite was formed by combining alternate sheets of Example Nos. 6 and 7 together, or alternatively combining alternating sheets of Example No. 7 with the sheets of Example No. 9. Example No. 11 spiral composite was formed by combining alternate sheets of Example Nos. 6 and 8 together, or alternatively combining alternating sheets of Example No. 8 with the sheets of Example No. 9. Example No. 12 spiral composite was formed by combining alternate sheets of Example Nos. 6, 7 and 8 together, or alternatively combining alternating sheets of Example Nos. 7 and 8 with the sheets of Example No. 9.

EXAMPLE NO. 14

Expanded Composite Construction Sheet (PCD)

An expended sheet comprising PCD and WC—Co was made from WC powder and Co powder having an average grain size in the range of from about one to six micrometers, and the PCD was in the form of powder having an average grain size in the range of from about 4 to 100 micrometers. The WC—Co contained greater than about six percent by weight Co, based on the total weight of the WC—Co. The expanded sheet had a thickness in the range of from about 30 to 300 micrometers after consolidation.

EXAMPLE NO. 15

Expanded Composite Construction Sheet (PCBN)

An expended sheet comprising cBN, WC—Co, TiC and Al was made from WC powder and Co powder having an average grain size in the range of from about one to six micrometers, and the PCBN was in the form of cBN powder having an average grain size in the range of from about 4 to 100 micrometers. The WC—Co contained greater than about six percent by weight Co, based on the total weight of the WC—Co. The expanded sheet had a thickness in the range of from about 30 to 300 micrometers after consolidation.

EXAMPLE NOS. 16 TO 18

Spiral Composites Constructions Comprising Expanded Sheets

Spiral composite constructions were prepared by combining alternating expanded sheets of Example Nos. 14 and 15 with the sheets of Example Nos. 6 to 9. Example No. 16 spiral composite was formed by combining alternate expanded sheets of Example No. 14 with the sheets of Example No. 6, or alternatively combining alternating expanded sheets of Example No. 14 with the sheets of Example No. 9. Example No. 17 spiral composite was formed by combining alternate expanded sheets of Example No. 15 with the sheets of Example No. 6, or alternatively combining alternating expanded sheets of Example No. 14 with the sheets of Example No. 9. Example No. 18 spiral composite was formed by combining alternate expanded sheets of Example No. 14 with the sheets of Example No. 6, and the expanded sheets of Example No. 15, or alternatively combining alternating expanded sheets of Example No. 14 with the sheets of Example No. 9, and the expanded sheets of Example No. 15.

Composite constructions having oriented microstructures of this invention can be used in a number of different applications, such as tools for mining, machining and construction applications, where the combined mechanical properties of high fracture toughness, wear resistance, and hardness are highly desired. Composite constructions of this invention can be used to form wear and cutting components in machine tools and drill and mining bits such as roller cone rock bits, percussion or hammer bits, diamond bits, and substrates for shear cutters.

Figure 8:
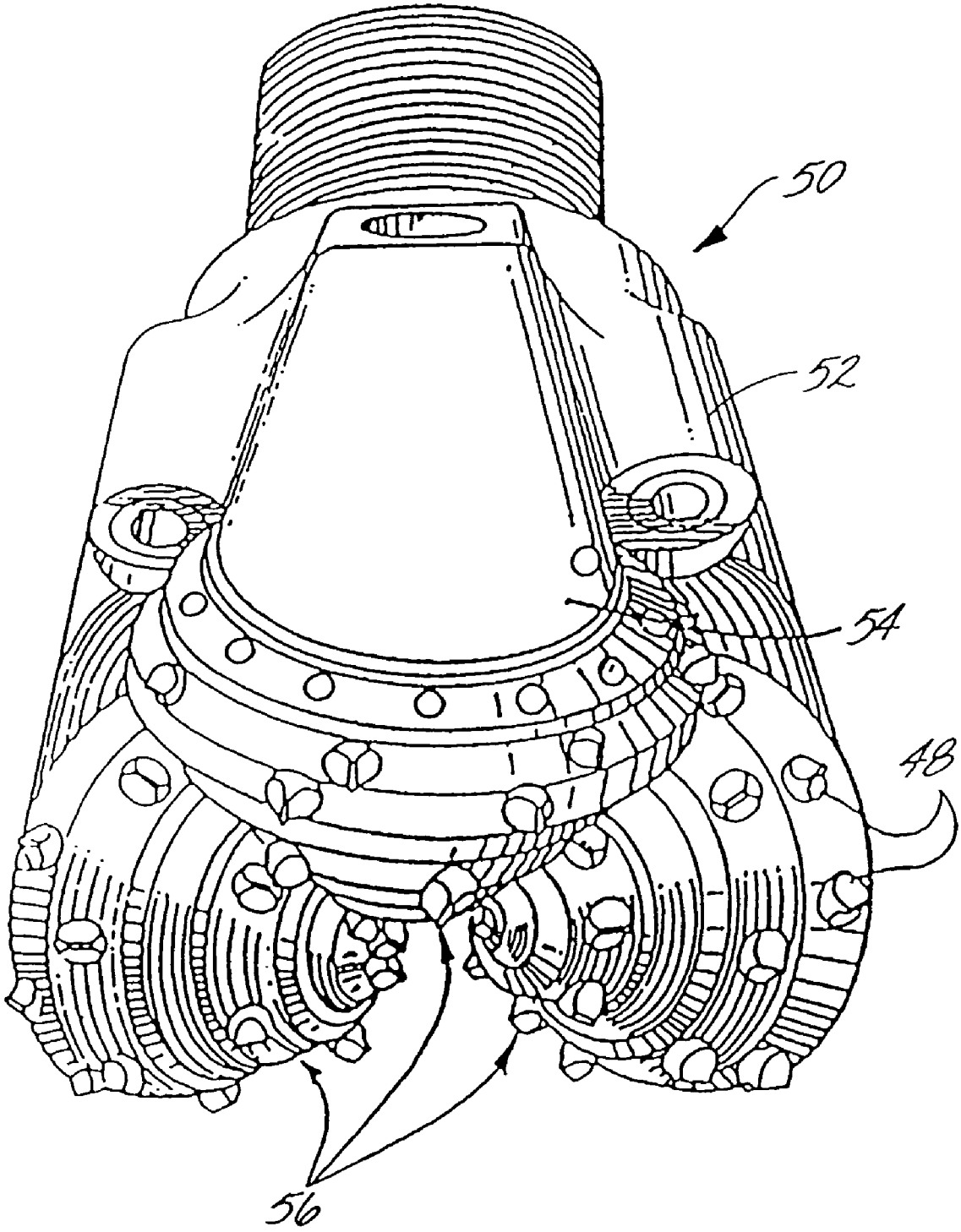
FIG. 8 is a perspective side view of a roller cond drill bit comprising a number of the inserts of FIG. 7.

For example, referring to FIG. 8, wear or cutting inserts 48 (shown in FIG. 7) formed from composite constructions of this invention can be used with a roller cone rock bit 50 comprising a body 52 having three legs 54, and a roller cutter cone 56 mounted on a lower end of each leg. The inserts 48 can be fabricated according to one of the methods described above. The inserts 48 are provided in the surfaces of the cutter cone 56 for bearing on a rock formation being drilled.

Figure 9:
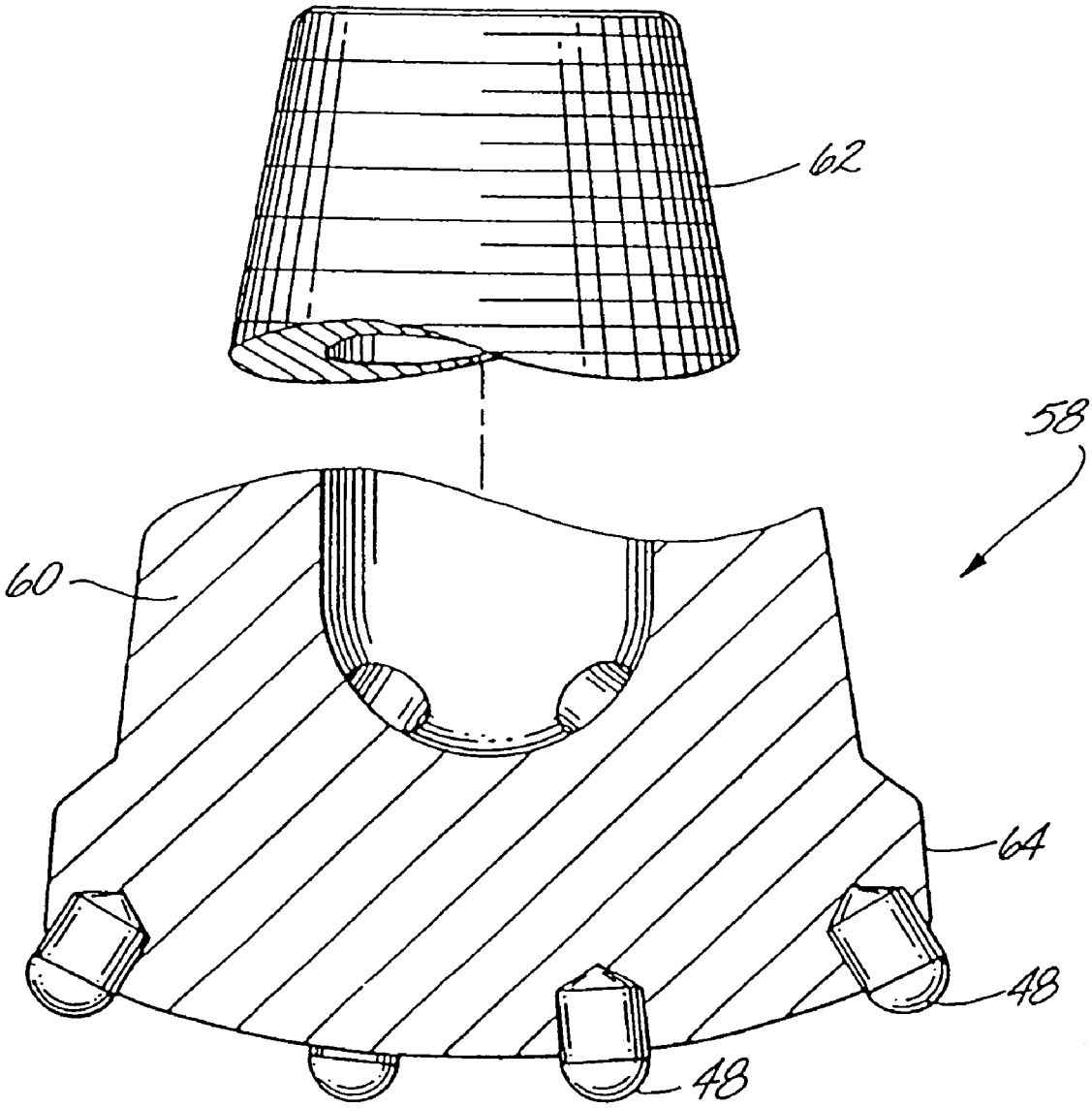
FIG. 9 is a perspective side view of a percussion or hammer bit comprising a number of inserts of FIG. 7.

Referring to FIG. 9, inserts 48 formed from composite constructions of this invention can also be used with a percussion or hammer bit 58, comprising a hollow steel body 60 having a threaded pin 62 on an end of the body for assembling the bit onto a drill string (not shown) for drilling oil wells and the like. A plurality of the inserts 48 are provided in the surface of a head 64 of the body 60 for bearing on the subterranean formation being drilled.

Figure 10:
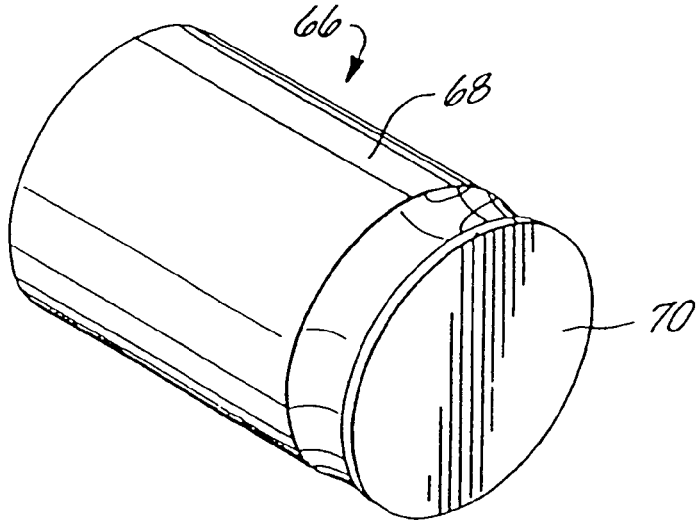
FIG. 10 is a schematic perspective side view of a polycrystalline diamond shear cutter comprising a substrate and/or cutting surface formed a composite construction of this invention.

Referring to FIG. 10, composite constructions of this invention can also be used to form PCD shear cutters 66 that are used, for example, with a drag bit for drilling subterranean formations. More specifically, composite constructions of this invention can be used to form a shear cutter substrate 68 that is used to carry a layer of PCD 70 that is sintered thereto or, alternatively, the entire substrate and cutting surface can be made from the composite construction.

Figure 11:
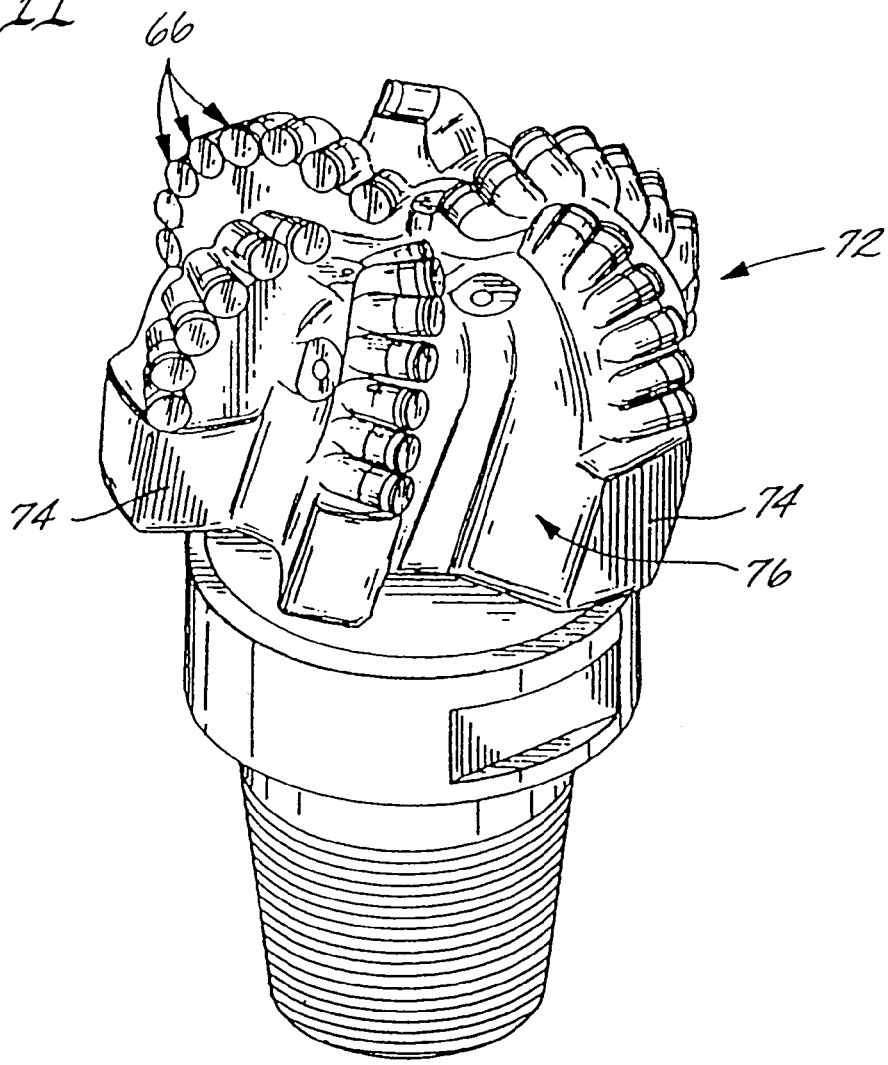
FIG. 11 is a perspective side view of a drag bit comprising a number of the shear cutters of FIG. 10.

Referring to FIG. 11, a drag bit 72 comprises a plurality of such PCD shear cutters 66 that are each attached to blades 74 that extend from a head 76 of the drag bit for cutting against the subterranean formation being drilled.

Although, limited embodiments of composite constructions having oriented microstructures, methods of making the same, and applications for the same, have been described and illustrated herein, many modifications and variations will be apparent to those skilled in the art. For example, although composite constructions have been described and illustrated for use with rock bits, hammer bits and drag bits, it is to be understood that composites constructions of this invention are intended to be used with other types of mining and construction tools. Accordingly, it is to be understood that within the scope of the appended claims, composite constructions according to principles of this invention may be embodied other than as specifically described herein.

What is claimed is:

1. A composite construction having an ordered arrangement of first and second material phases, the construction being formed by the process of:

combining one or more precursor materials selected from the group consisting of ceramics, metals, diamond, cubic boron nitride, and mixtures thereof to form a green-state first material phase part;

combining one or more materials to form a green-state second material phase part, wherein one of the first or second material phase parts does not include a ceramic material;

joining together a number of the first and second green-state material phase parts to form a green-state assembly, wherein at least one of the first and second green-state material phase parts are commonly oriented within the assembly; and consolidating and sintering the green-state assembly at high pressure/high temperature conditions to form the composite construction;

wherein the sintered first material phase has a hardness that is relatively greater than the sintered second material phase in the composite construction.

2. The composite construction as recited in claim 1 wherein the composite construction comprises a material microstructure characterized by a plurality of the first material phases disposed within a continuous matrix of the second material phase.

3. The composite construction as recited in claim 2 wherein the plurality of first material phases are aligned with an axis perpendicular to a working surface of the composite construction.

4. The composite construction as recited in claim 1 wherein the materials used to form the second green-state material phase parts are selected from the group consisting of ceramics, Co, Ni, Fe, W, Mo, Cu, Al, Nb, Ti, Ta, and alloys thereof.

5. An insert for use in a subterranean drill bit, the insert having a wear surface comprising the composite construction of claim 1.

6. A shear cutter for use in a subterranean drill bit, the shear cutter having a wear surface comprising the composite construction of claim 1.

* * * * *